US009957778B2

(12) United States Patent
Jensen

(10) Patent No.: US 9,957,778 B2
(45) Date of Patent: May 1, 2018

(54) DOWNHOLE WIRELINE CLEANING TOOL

(71) Applicant: WELLTEC A/S, Allerød (DK)

(72) Inventor: Sven Karsten Jensen, Stenløse (DK)

(73) Assignee: Welltec A/S, Allerød (DK)

( * ) Notice: Subject to any disclaimer, the term of this patent is extended or adjusted under 35 U.S.C. 154(b) by 79 days.

(21) Appl. No.: 15/021,788

(22) PCT Filed: Sep. 16, 2014

(86) PCT No.: PCT/EP2014/069676
§ 371 (c)(1),
(2) Date: Mar. 14, 2016

(87) PCT Pub. No.: WO2015/040014
PCT Pub. Date: Mar. 26, 2015

(65) Prior Publication Data

US 2016/0230508 A1 Aug. 11, 2016

(30) Foreign Application Priority Data

Sep. 17, 2013 (EP) ..... 13184806

(51) Int. Cl.
*E21B 37/02* (2006.01)
*E21B 4/04* (2006.01)
*E21B 10/32* (2006.01)

(52) U.S. Cl.
CPC ..... *E21B 37/02* (2013.01); *E21B 4/04* (2013.01); *E21B 10/32* (2013.01)

(58) Field of Classification Search
CPC ..... E21B 37/02; E21B 10/32; E21B 4/04
See application file for complete search history.

(56) References Cited

U.S. PATENT DOCUMENTS 4,279,299 A * 7/1981 Shuck ..... E21B 37/00 166/277
6,561,286 B2 * 5/2003 Armell ..... E21B 10/322 175/286

(Continued)

FOREIGN PATENT DOCUMENTS

CN 102056557 A 5/2011
EP 2 530 238 12/2012

(Continued)

OTHER PUBLICATIONS

Notification Concerning Transmittal of International Preliminary Report on Patentability (Chapter I of the Patent Cooperation Treaty) dated Mar. 31, 2016 issued in International Application No. PCT/EP2014/069676 (7 pages).

(Continued)

*Primary Examiner* — Brad Harcourt
(74) *Attorney, Agent, or Firm* — Nixon & Vanderhye P.C.

(57) ABSTRACT

Downhole wireline cleaning tool (1) adapted to scrape and remove objects, such as scale decreasing an inner diameter of a casing in a wellbore, comprising a tool housing (4) having a first housing part (5) and a second housing part (6), a projectable arm (7) which is pivotably connected with the first housing part at a first end of the projectable arm, the projectable arm having a plurality of bits (9) in a second end, said projectable arm (7) being movable between a retracted position and a projected position in relation to the tool housing (4), an arm activation assembly (11) for moving the projectable arm between the retracted position and the projected position, and a rotatable shaft (12) for rotating the projectable arm (7), wherein the bits are arranged along an extension of the projectable arm, wherein the extension of the arm extends across the center tool axis in at least the (Continued)

retracted position, so that the bits of the arm are arranged to scrape the entire internal cross-sectional area of the casing.

20 Claims, 14 Drawing Sheets

(56) References Cited

U.S. PATENT DOCUMENTS

| | | | | |
|---|---|---|---|---|
| 8,210,251 | B2 | 7/2012 | Lynde et al. | |
| 2005/0217861 | A1* | 10/2005 | Misselbrook | E21B 17/20 166/373 |
| 2008/0245523 | A1* | 10/2008 | Potter | E21B 17/1028 166/173 |
| 2010/0258289 | A1 | 10/2010 | Lynde et al. | |
| 2011/0005836 | A1 | 1/2011 | Radford et al. | |

FOREIGN PATENT DOCUMENTS

| | | |
|---|---|---|
| WO | WO 03/010410 | 2/2003 |
| WO | WO 2010/054407 | 5/2010 |

OTHER PUBLICATIONS

International Search Report and Written Opinion for PCT/EP2014/069676, dated Dec. 5, 2014, 10 pages.

Notification of the First Office Action dated Jan. 3, 2018 in Chinese Application No. 201480048611.1, with English translation (10 pages).

* cited by examiner

DOWNHOLE WIRELINE CLEANING TOOL

This application is the U.S. national phase of International Application No. PCT/EP2014/069676 filed 16 Sep. 2014, which designated the U.S. and claims priority to EP Patent Application No. 13184806.1 filed 17 Sep. 2013, the entire contents of each of which are hereby incorporated by reference.

FIELD OF THE INVENTION

The present invention relates to a downhole wireline cleaning tool adapted to scrape and remove objects, such as scale decreasing an inner diameter of a casing in a wellbore, and thereby increase said inner diameter to its initial inner diameter. The present invention also relates to a downhole system comprising the downhole wireline cleaning tool as described above and to a cleaning method for cleaning a well.

BACKGROUND ART

A well often has restrictions, such as nipples, no-goes or patches, and the inner diameter at this restriction therefore defines the maximum outer diameter of an intervention tool intervening the well to perform an operation. Cleaning a lower part of the well requires a flexible brush capable of bending its brushing arms when passing the restriction. Furthermore, wells sometimes have a cased part and an un-cased part, the un-cased part also being referred to as an open hole well. In order to clean the open hole part, the brush or similar cleaning tool also has to be flexible in order to pass the narrow cased part. However, it has proved to be difficult for known cleaning brushes to clean certain types of scale which could more easily be removed by a somewhat flexible brush.

SUMMARY OF THE INVENTION

It is an object of the present invention to wholly or partly overcome the above disadvantages and drawbacks of the prior art. More specifically, it is an object to provide an improved cleaning tool capable of passing restrictions and cleaning scale in a well.

The above objects, together with numerous other objects, advantages and features, which will become evident from the below description, are accomplished by a solution in accordance with the present invention by a downhole wireline cleaning tool adapted to scrape and remove objects, such as scale decreasing an inner diameter of a casing in a wellbore, and thereby increase said inner diameter to an initial inner diameter of the casing, the casing having an internal cross-sectional area encircled by a wall of the casing and the tool having a centre tool axis and extending in a longitudinal direction, comprising:

- a tool housing having a first housing part and a second housing part,
- a projectable arm which is pivotably connected with the first housing part at a first end of the projectable arm, the projectable arm having a plurality of bits in a second end, said projectable arm being movable between a retracted position and a projected position in relation to the tool housing in order to bring the bits in contact with the object,
- an arm activation assembly for moving the projectable arm between the retracted position and the projected position, and

- a rotatable shaft arranged in the second housing part and rotatably connected with the first housing part for rotating the projectable arm, wherein the bits are arranged along an extension extending from the second end towards the first end of the projectable arm, which extension is curved in order to vary a distance from the tool housing to the bit in contact with the object upon rotation of the projectable arm, and wherein the extension of the arm extends across the centre tool axis in at least the retracted position, so that the bits of the arm are arranged to scrape the entire internal cross-sectional area of the casing when the arm is rotated.

The downhole wireline cleaning tool according to the present invention may have a plurality of projectable arms, and the extension of at least one of the arms may extend across the centre tool axis in at least the retracted position.

Moreover, the downhole wireline cleaning tool as described above may have at least two opposing projectable arms, each having the extension extending from the centre tool axis and radially outwards, so that the bits of the opposing projectable arms are arranged to scrape the entire internal cross-sectional area of the casing when the arms are rotated.

Also, bits of one of the two opposing arms may be arranged offset in relation to the bits of the other of the opposing arms.

By having the bits arranged offset, the bits may cover a larger area of the casing than if the bits are arranged entirely opposite each other. The trajectories defined by the bits of one arm during rotation may be arranged offset in relation to the trajectories defined by the bits of the other arm during rotation. In this way, the resulting scraping area is increased when rotating the arms.

Furthermore, the projectable arm may be pivotably connected with the first housing part around a pivot point, which pivot point may be fixedly connected with the first housing part, so that during the removal of the objects, the pivot point is adapted to withstand the resulting force in the longitudinal direction.

By having the pivot point fixedly connected with the first housing part, the projectable arm(s) may be prevented from yielding in relation to the first housing part.

Further, the bits may be non-cutting bits.

Moreover, the bits may be scraping bits.

Also, the rotatable shaft may rotate around the centre tool axis.

The extension of bits may be curved.

The projectable arm may have a crescent shape, an L-shape, may be partly U-shaped or have similar half-round shape.

Also, the projectable arm activation assembly may comprise a motor, an at least partly threaded shaft rotated by the motor, and a projectable arm activation assembly housing having a thread engaging the thread of the shaft, the threaded shaft being arranged inside the rotatable shaft.

Moreover, the projectable arm activation assembly may comprise a piston housing arranged in the first housing part and comprising a piston chamber, and a piston member arranged inside the piston chamber to move the projectable arm between the retracted position and the projected position, the piston member being movable in the longitudinal direction of the downhole tool and having a first piston face, the piston member being capable of applying a projecting force on the projectable arm by applying hydraulic pressure on the first piston face and moving the piston in a first direction.

The downhole wireline cleaning tool as described above may further comprise a pump driving the arm activation assembly, the pump being driven by a motor powered through the wireline.

Furthermore, the piston chamber may be divided into a first chamber section and a second chamber section, and the hydraulic pressure on the first piston face, moving the piston in the first direction, may be applied to the first chamber section.

Additionally, hydraulic pressure may be applied to the second chamber section, moving the piston member in a second direction opposite of the first direction.

Also, the chamber may be divided by the piston.

In addition, the chamber may be divided by a partitioning wall of the piston housing, through which partitioning wall the piston member extends.

Moreover, the second chamber may have a channel allowing well fluid to enter the second chamber when the piston member is moved in the first direction.

Moreover, the piston member may have a groove cooperating with a second end of the projectable arm.

Further, the projectable arm may have a curved shape curving from the second end towards the first end.

The projectable arm may have a cross-sectional shape transverse to the extension, the cross-sectional shape being partly round.

Additionally, the bits may be arranged in two rows, the rows being displaced so that one bit in one row is arranged between two bits in the other row.

Also, the rows may extend from the second end to the first end.

Furthermore, the two rows of bits may be arranged spaced apart along the partly round, cross-sectional shape.

A spring member may be arranged in the activation assembly, applying a spring force to move the projectable arm from the projected position to the retracted position.

Moreover, the threaded shaft may have a groove cooperating with a second end of the projectable arm.

In addition, the spring member may be arranged in the first housing part, applying a spring force to move the piston member in a second direction opposite the first direction.

Further, the spring member may be arranged in the second chamber section. Also, the at least partly threaded shaft may have a groove cooperating with a second end of the projectable arm.

Furthermore, the arm activation assembly may comprise a shear pin shearing in the event that the projectable part gets stuck in the well.

The downhole wireline cleaning tool as described above may further comprise a driving unit for propelling the tool forward in the well.

The present invention also relates to a downhole system comprising a downhole wireline cleaning tool as described above and a casing having a restriction.

Finally, the present invention relates to a cleaning method for cleaning a well having a restriction, comprising the steps of:

- submerging a downhole wireline cleaning tool as described above for performing a cleaning operation,
- passing the restriction with the projectable arms being in the retracted position, and
- moving the projectable arms from the retracted position to the projected position opposite a part of the well to be cleaned.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
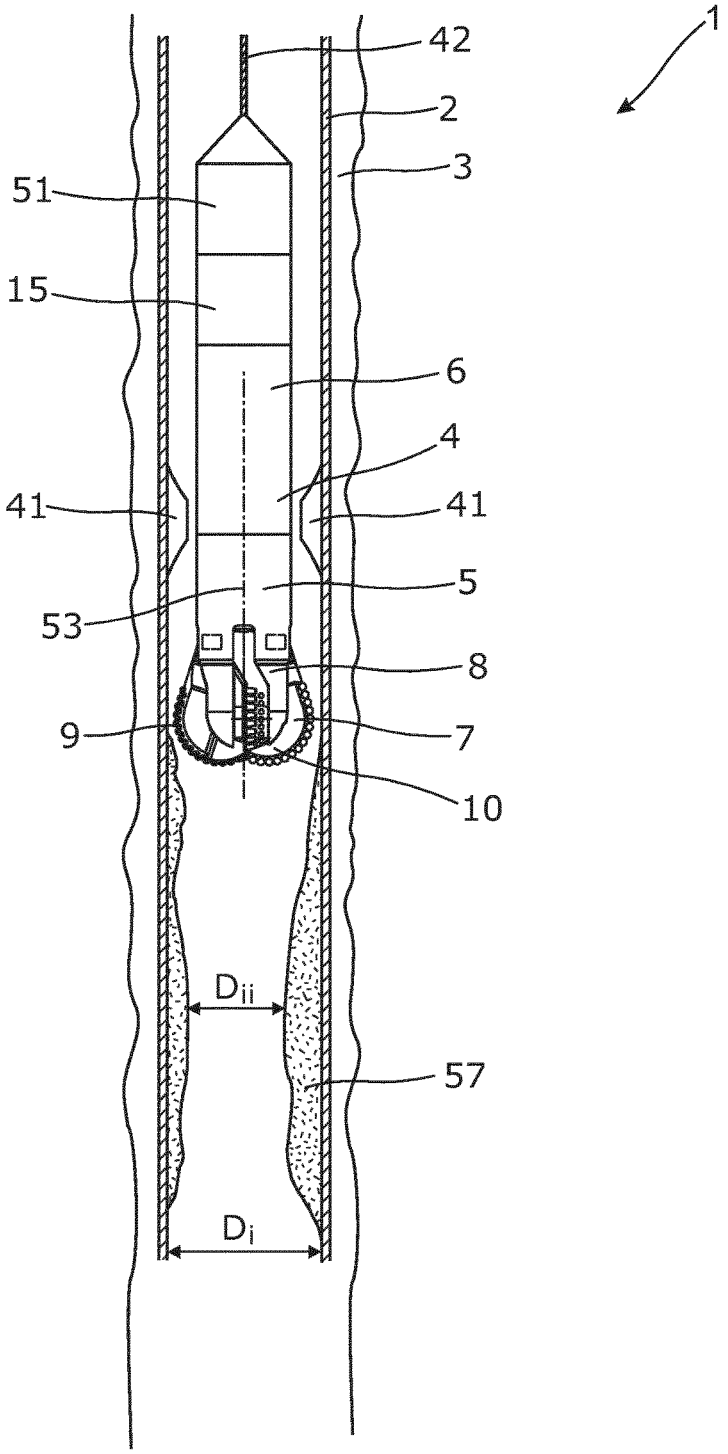
FIG. 1 shows a downhole wireline cleaning tool having just passed a restriction.

FIG. 1 shows a downhole wireline cleaning tool 1 adapted to scrape and remove objects, such as scale 57 decreasing an inner diameter of a casing 2 in a wellbore 3, and thereby increase said inner diameter Di to its initial inner diameter Dii, and the scale are thus removed due to the fact that they reduce the flow of oil or gas from the reservoir. The casing has a restriction 41 decreasing the inner diameter of the casing, and the scale to be removed is arranged further down the casing, so that the tool has to pass the restriction before arriving at the scale. The tool comprises a tool housing 4 having a first housing part 5 and a second housing part 6, and at least one projectable arm 7 which is pivotably connected with the first housing part at a first end 8 of the arm. The projectable arm 7 has a plurality of bits 9 along an extension in a second end 10 and towards the first end 8. The projectable arm is movable between a retracted position (shown in FIG. 4) and a projected position (shown in FIG. 3) in relation to the tool housing in order to bring the bits in contact with the scale an in order to scrape off the scale. The tool comprises a motor 15 powered through a wireline 42 and is shown in its projected position in FIG. 1, and in the partial view shown in FIG. 2, in which the tool is ready to remove the scale and clean the casing from within when rotating the arm.

Figure 10:
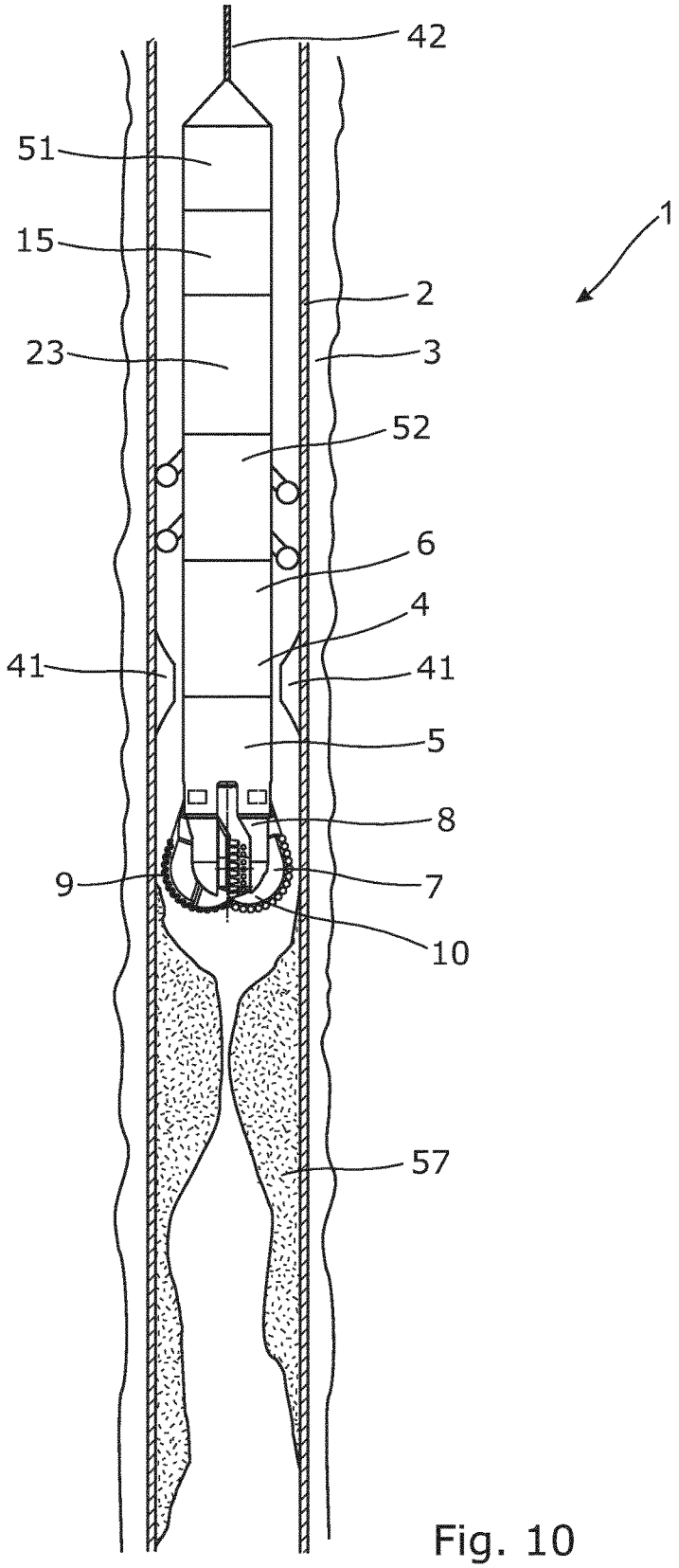
FIG. 10 shows yet another downhole wireline cleaning tool having a driving unit for propelling the tool forward in the well.
Figure 14:
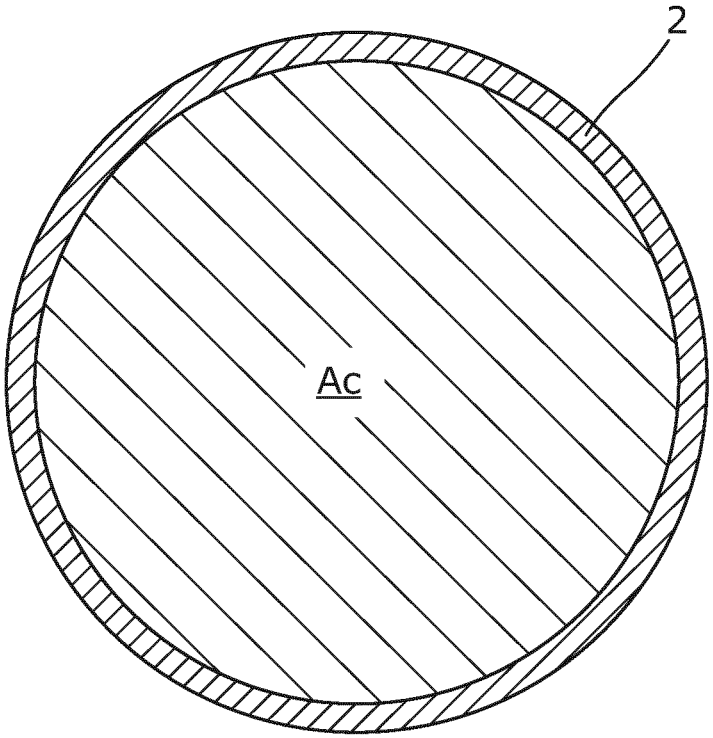
FIG. 14 shows the internal cross-sectional area of the casing.

The extension of bits along part of the arm extends across a centre tool axis 53 in at least the retracted position, so that the bits of the arm are arranged to scrape the entire internal cross-sectional area $A_c$ of the casing (shown in FIG. 14) even when the initial diameter is almost zero as shown in FIG. 10.

By having a cleaning tool with a projectable arm, the tool is capable of passing a restriction with the projectable arm in its retracted position and subsequently projects the arm to a projected position corresponding to the inner diameter of the casing and removes the scale from the inner surface of the casing. Furthermore, the tool is capable of cleaning an open hole part of the well (shown below in FIG. 1) by passing a cased part having a smaller inner diameter than the open hole part. When the tool has passed through the cased part of the well, the arms are projected to match the inner diameter of the open hole part of the well, and the cleaning operation can begin. Furthermore, because the extension of bits extends across the centre tool axis 53, the cleaning tool is capable of cleaning a casing even though the casing is fully blocked or almost fully blocked with scale.

Figure 3:
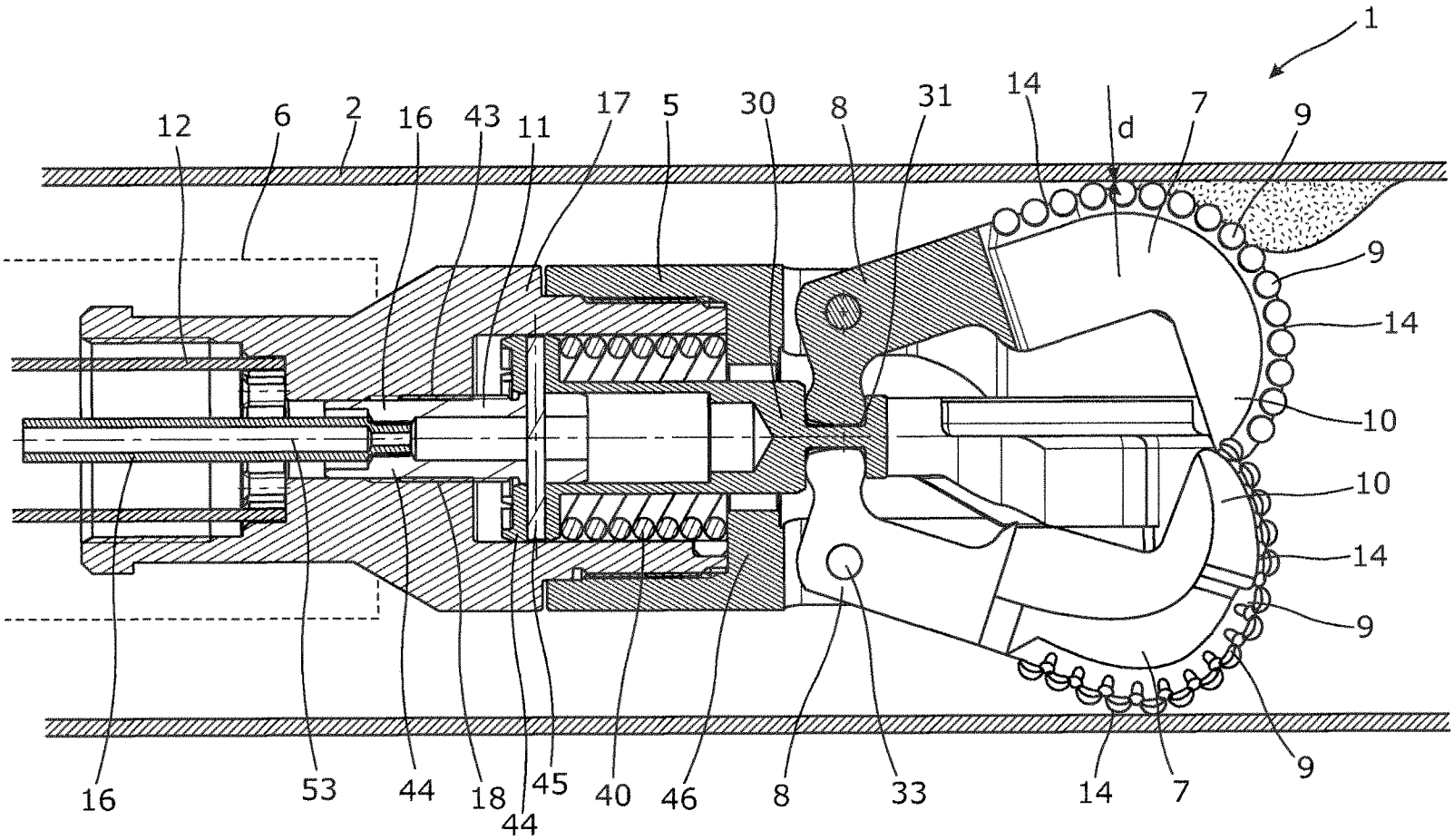
FIG. 3 shows a partial, cross-sectional view of the downhole wireline cleaning tool of FIG. 2 in a projected position.
Figure 4:
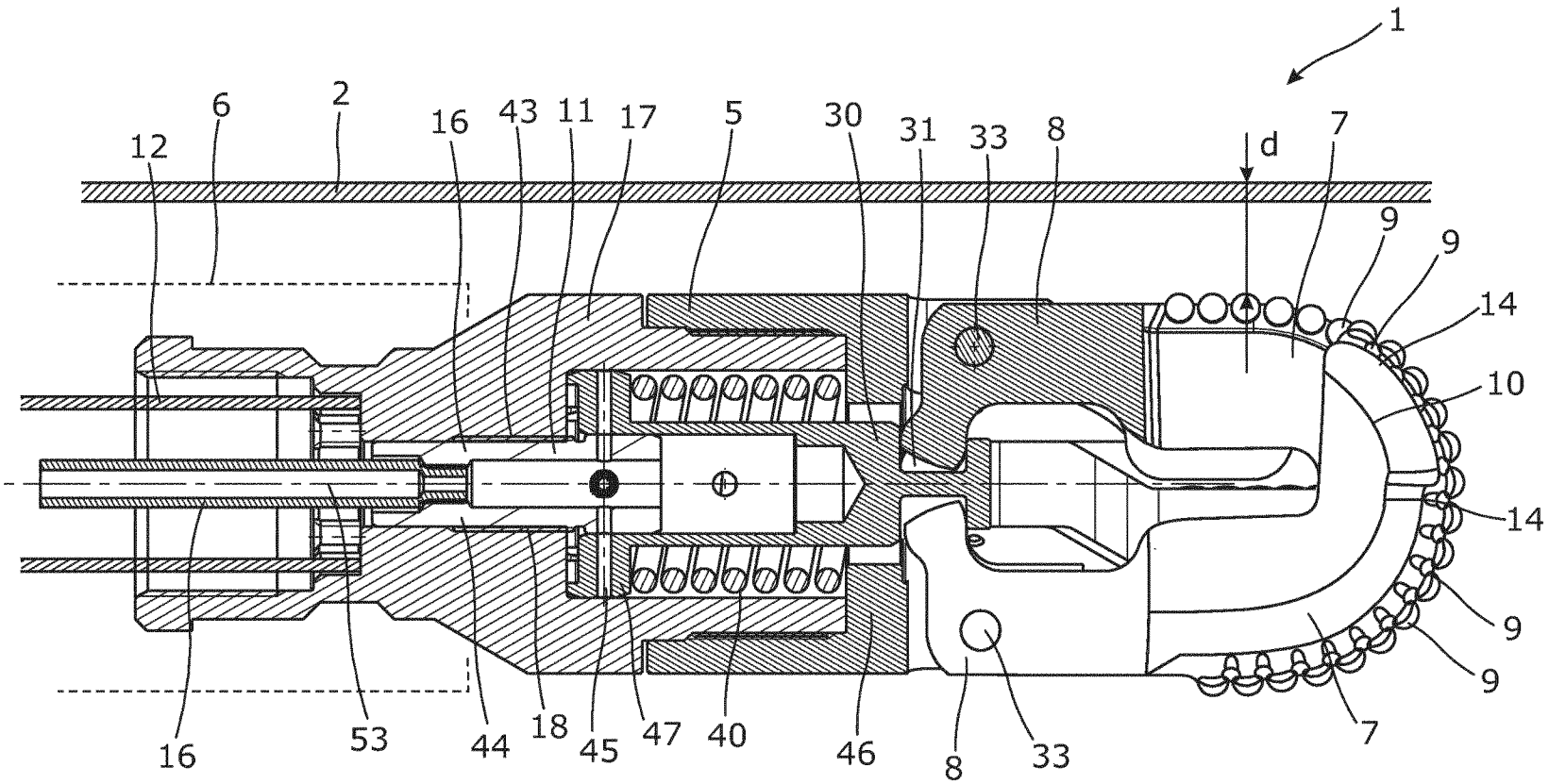
FIG. 4 shows a partial, cross-sectional view of the downhole wireline cleaning tool of FIG. 2 in a retracted position.

The motor 15 of the downhole wireline cleaning tool 1 rotates a rotatable shaft 12 shown in FIG. 3 which shaft is arranged in the second housing part 6 and is rotatably connected with the first housing part 5 to rotate the projectable arm 7. In this way the bits 9 are rotated and are capable of removing scale all the way around a circumference of the casing. The downhole wireline cleaning tool 1 further comprises an arm activation assembly 11 for moving the projectable arm between the retracted position and the projected position. The bits are arranged along the extension 14 extending from the second end 10 towards the first end 8 of the projectable arm 7. The extension is curved in order to vary a distance d from the tool housing to the bit in contact with the object upon rotation of the arm. In FIG. 3, the projectable arm is projected to an extent which results in the distance being approximately 0 due to the fact that the bits contact the inner face of the casing. In FIG. 4, the projectable arms are in the retracted position resulting in the distance being larger than 0 and having a maximum value.

Figure 2:
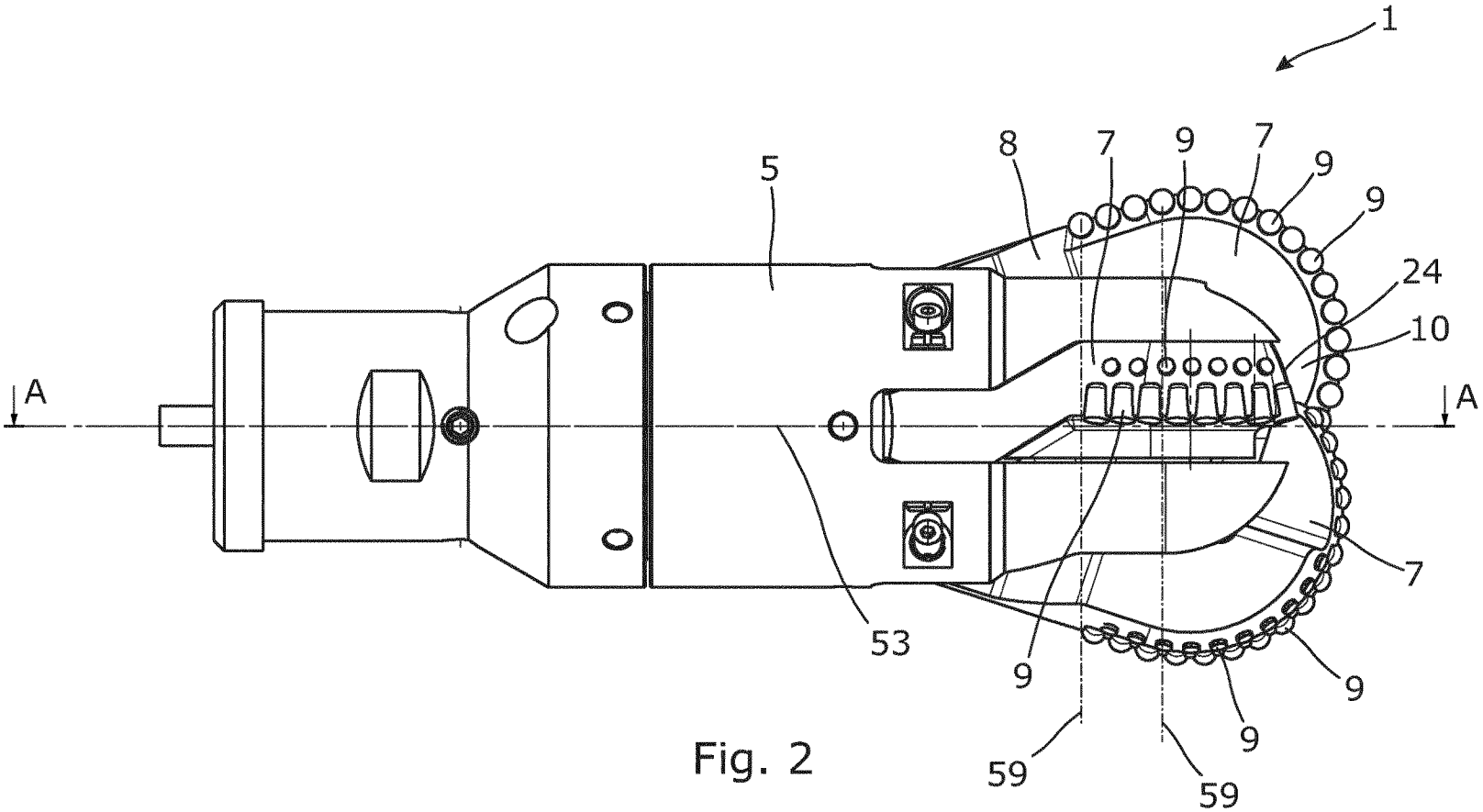
FIG. 2 shows a perspective view of part of the downhole wireline cleaning tool having bits arranged on projectable arms.
Figure 5:
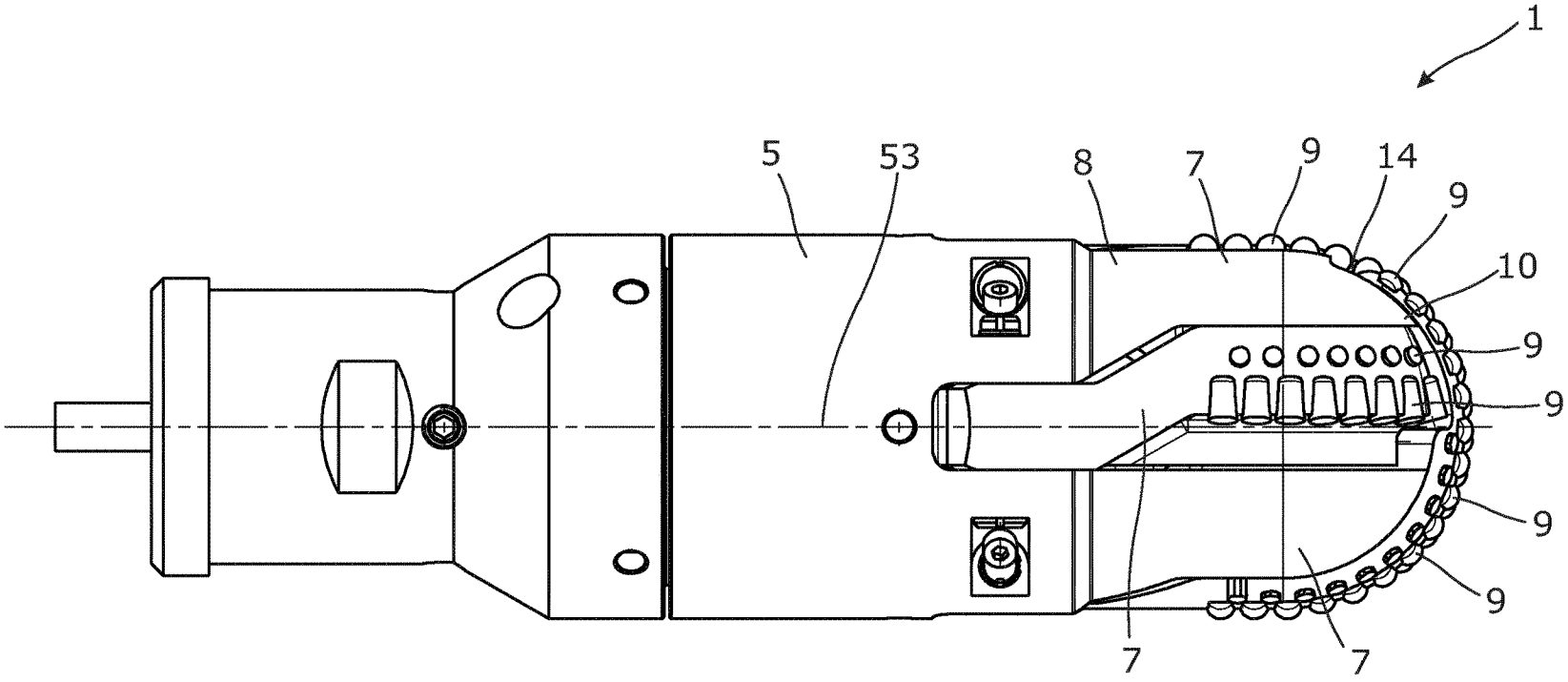
FIG. 5 shows a perspective view of part of another downhole wireline cleaning tool having bits arranged on projectable arms.

As can be seen in FIGS. 1 and 2, the downhole wireline cleaning tool has a plurality of projectable arms, and at least one of the arms has the extension extending across the centre tool axis in at least the retracted position as shown in FIGS. 4 and 5 or the projected position shown in FIGS. 1 and 2. The downhole wireline cleaning tool is shown having two opposing projectable arms extending across the centre tool axis. The two opposing projectable arms each have the extension extending from the centre tool axis and radially outwards when seen from the front of the tool, so that the bits of the opposing projectable arms are arranged to scrape the entire internal cross-sectional area of the casing when the arms are rotated.

In FIG. 2, the bits of one of the two opposing arms are arranged offset in relation to the bits of the other of the opposing arms. This is illustrated by the dotted lines 59. By having the bits of one arm arranged offset in relation to bits of another arm, the bits are capable of scraping a larger area of the casing than if the bits are arranged entirely opposite each other. The trajectories defined by the bits of one arm during rotation are thus arranged offset in relation to the trajectories defined by the bits of the other arm during rotation. In this way, the resulting scraping area is increased when rotating the arms.

The downhole wireline cleaning tool 1 scrapes the casing from within and thus removes the objects, such as scale, without cutting into the casing. The bits are thus non-cutting bits or scraping bits.

The arm activation assembly allows for the adjustment of the position of the projectable arm. The arm can thus be retracted for passing a restriction and subsequently be projected again, and such adjustment can be made from surface by activating the arm activation assembly from surface by sending control signals to a control unit 51 (shown in FIGS. 9 and 10) through the wireline. By having bits arranged along the curved extension, some of the bits will always be in contact with the object to be cleaned, independently of the position of the projectable arm. Often when operating downhole, the inner diameter may vary more than expected, and the scale may block almost the whole casing and/or a restriction, such as a no-go, may be arranged at an unexpected position along the casing. Therefore, by being able to adjust the position of the arm, the tool does not have to be retracted from the well if unexpected limitations occur downhole, since the arms may just be retracted and the tool will then able to pass the restriction or remove the scale. Therefore by having such adjustable cleaning tool, the tool is able to clean the inner surface of the casing even though restrictions are arranged further up the well and even though scale almost fully blocks the casing.

The arm activation assembly of FIGS. 3 and 4 comprises a partly threaded shaft 16 having a thread 43 and being rotated by the motor. The arm activation assembly comprises an arm activation assembly housing 17 having an internal thread 18 engaging the thread 43 of the shaft. The threaded shaft is arranged inside the rotatable shaft 12, and upon rotation of the threaded shaft in a first direction, the threaded shaft moves in relation to the arm assembly housing 17 and away from the second housing part 6, resulting in a projection of the projectable arms 7 as shown in FIG. 3. When rotating the threaded shaft 16 in a second direction opposite the first, the projectable arms are retracted as shown in FIG. 4.

The partly threaded shaft 16 has a first end part 30 extending out of the arm assembly housing 17 and a second end part 44 which is threadedly connected with the arm activation assembly housing 17. The first end part 30 and the second end part of the partly threaded shaft are connected by shear pins 45. The partly threaded shaft engages the projectable arm by having a circumferential groove 31 into which the first end 8 of the projectable arm extends. The first end 8 of the projectable arm is rounded to be able to rotate in the groove. The projectable arm is pivotably connected with the first housing 5 around a pivot point 33. When projecting the projectable arm 7, a spring is arranged in a cavity of the housing 17 and between a flange 46 of the housing 17 and the second end part 44 of the threaded shaft 16. The cavity is often filled with grease to prevent well fluid from entering the tool. If the tool gets stuck in the hole, the shear pin 45 shears when the second end part 44 is moved towards the first end part 30 of the threaded shaft. Subsequently, the spring forces the first end part 30 to move towards the second housing part 6 and the arms are thus retracted, and thus the spring provides a fail safe function.

Figure 6:
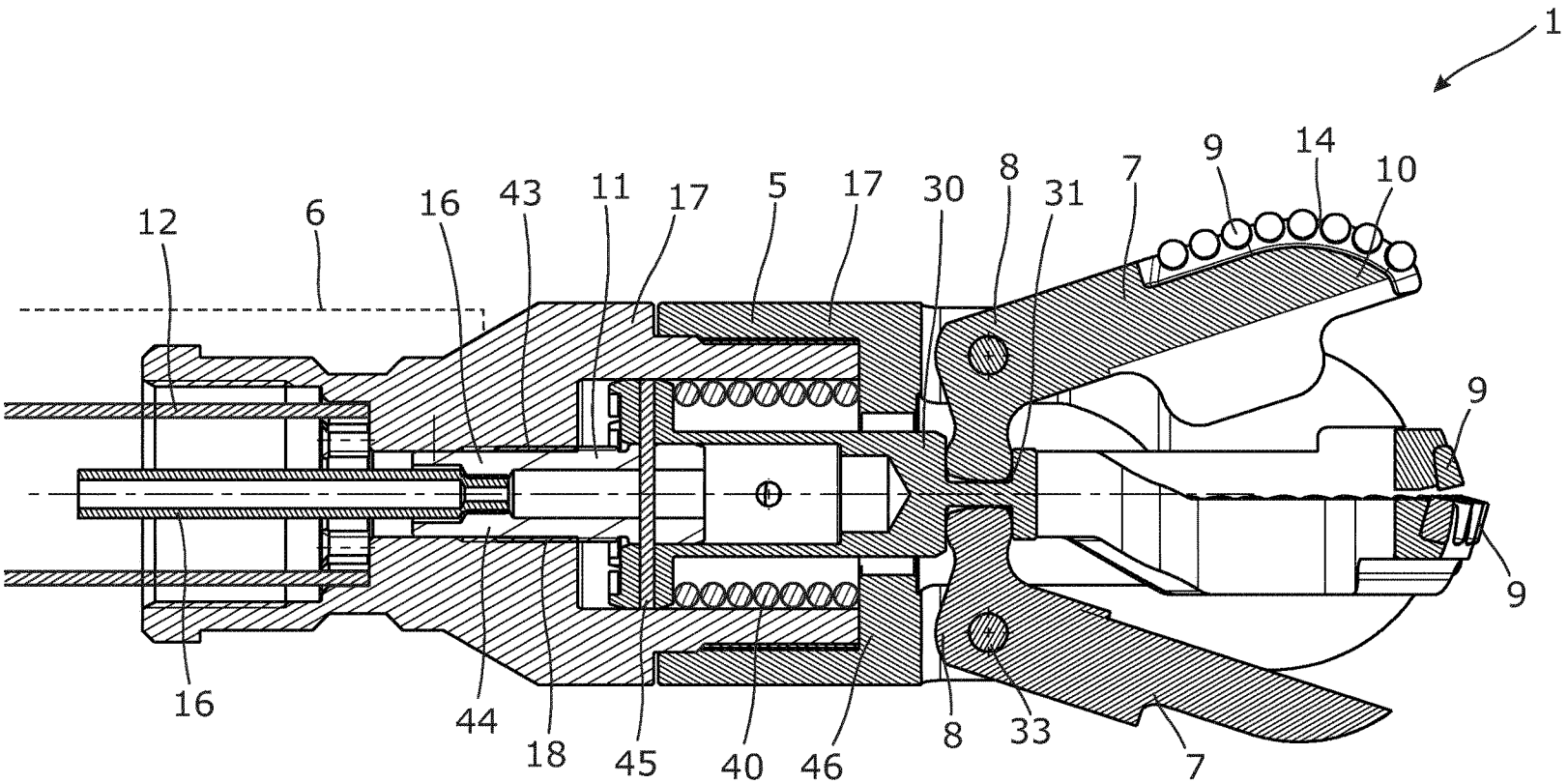
FIG. 6 shows a partial, cross-sectional view of the downhole wireline cleaning tool of FIG. 5 in a projected position.
Figure 7:
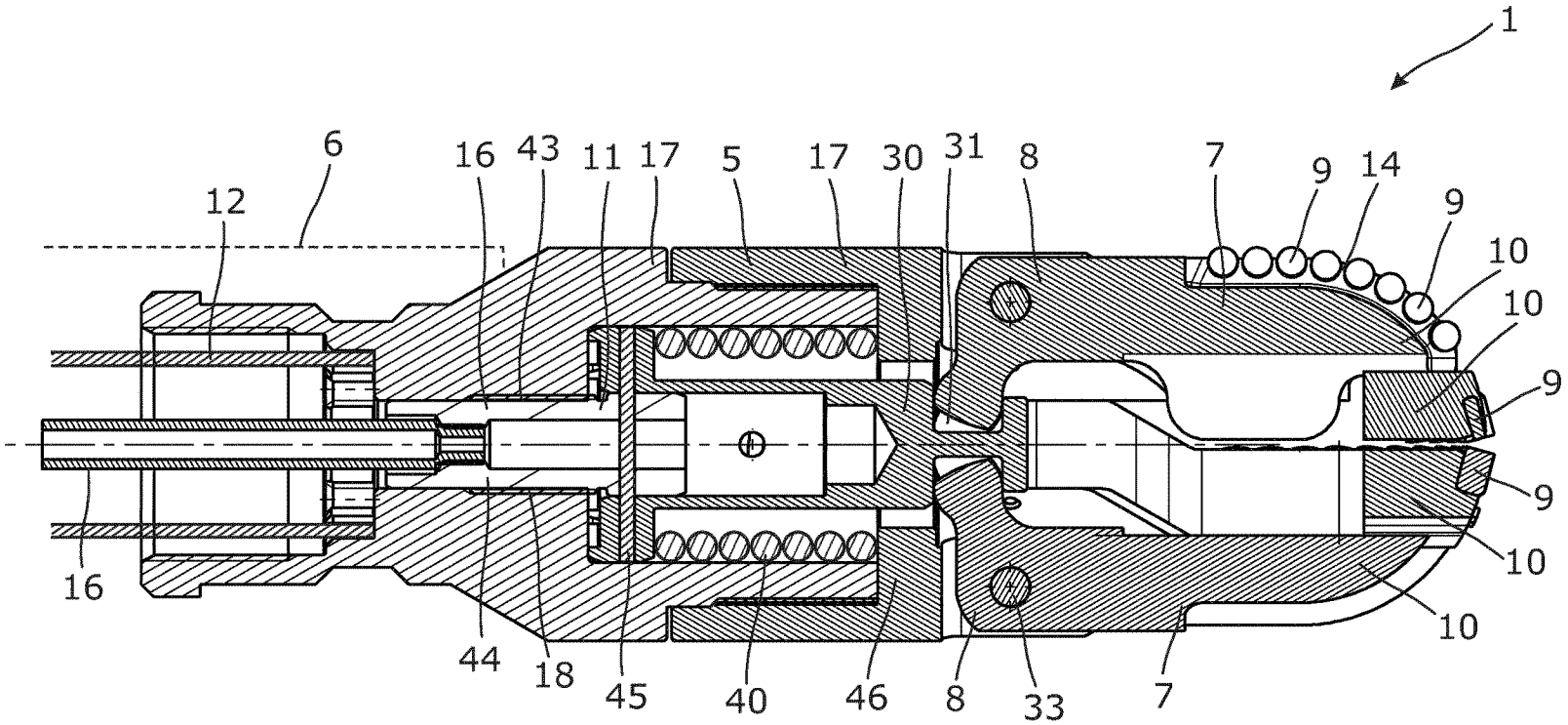
FIG. 7 shows a partial, cross-sectional view of the downhole wireline cleaning tool of FIG. 2 in a retracted position.

In FIGS. 2-4, the projectable arm 7 is partly U-shaped and the arm is substantially L-shaped having a rounded extension. One leg of the "U" has been cut off and the other is hingedly connected to the first housing part 5 in the pivot point 33. In FIGS. 5-7, the projectable arms are I-shaped having a rounded extension 14 on which the bits 9 are arranged. The downhole wireline cleaning tool 1 may have a combination of the I-shaped arms shown in FIGS. 5-8 and the partly U-shaped arms shown in FIGS. 2-4 in order to provide room for all four arms when the arms are in their retracted position.

The projectable arm is pivotably connected with the first housing part around a pivot point 33, which is fixedly connected with the first housing part, so that during the removal of the objects, the pivot point is adapted to withstand the resulting force in the longitudinal direction. By having the pivot point fixedly connected with the first housing part, the projectable arm(s) is(are) prevented from yielding in relation to the first housing part when the bits scrape off the scale, and thus a resulting force in the longitudinal direction from the bits hitting the scale and casing is not pressing the arm backwards.

Figure 8:
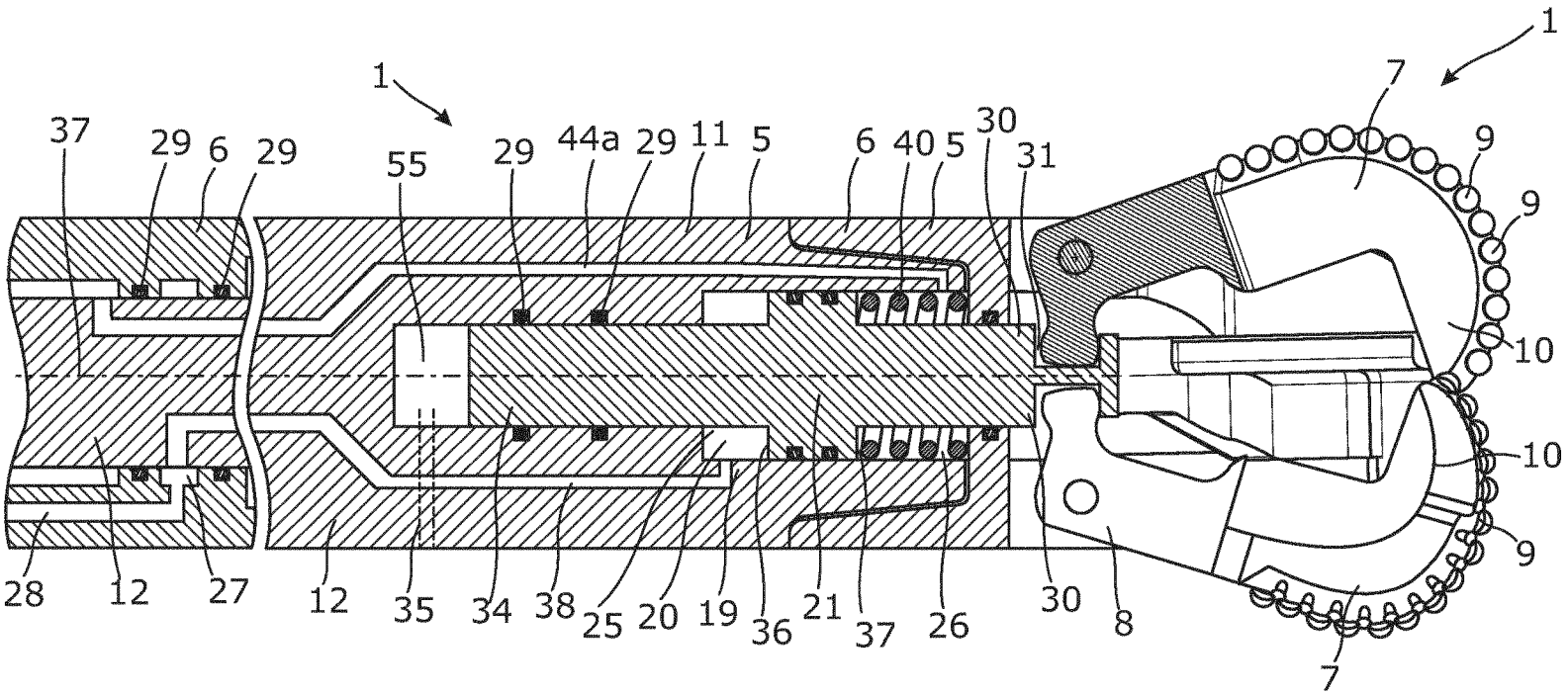
FIG. 8 shows a partial, cross-sectional view of yet another downhole wireline cleaning tool in a projected position.

In FIG. 8, the arm activation assembly comprises a piston housing 19 which is arranged in the first housing part and comprises a piston chamber 20, and a piston member 21 arranged inside the piston chamber to move the projectable arm between the retracted position and the projected position, the piston member being movable in the longitudinal direction of the downhole wireline cleaning tool 1 and having a first piston face 36, the piston member being capable of applying a projecting force on the projectable arm by applying hydraulic pressure on the first piston face and moving the piston in a first direction.

As shown in FIG. 8, the arm activation assembly 11 comprises a piston housing 19 which is arranged in the first housing part 5 and comprises a piston chamber 20. A piston member 21 is arranged inside the piston chamber and engages with the projectable arm 7, thereby moving the projectable arm 7 between the retracted position and the projected position. The piston member 21 is movable in a longitudinal direction of the downhole wireline cleaning tool 1 and has a first piston face 36 and a second piston face 37. Hydraulic fluid from the pump is pumped into a first chamber section 25 of the chamber 20 through a first fluid channel 38, applying a hydraulic pressure on the first piston face 36, and the piston moves in a first direction, applying a projecting force on the projectable arm 7.

When the projectable arm is projected to press against an inner face of the casing or drill pipe and is simultaneously rotated by the motor through the rotatable shaft, the bits 9 are capable of removing scale from the casing.

In FIG. 8, the rotatable shaft 12 supplies the fluid to the first section 25 of the chamber 20. The fluid from the pump is supplied to the shaft 12 through a circumferential groove 27 fluidly connected with a second fluid channel 28 in the second housing part 6. Thus, the fluid from the second fluid channel 28 is distributed in the circumferential groove 27, so that the first fluid channel 38 in the rotatable shaft 12 is always supplied with pressurised fluid from the pump while rotating. The circumferential groove 27 is sealed off by means of circumferential seals 29, such as O-rings, on both sides of the circumferential groove 27.

The piston member moves in the longitudinal direction of the tool 1 inside the piston chamber and divides the chamber 20 into a first chamber section 25 and a second chamber section 26. When the piston member moves in the first direction, a spring member 40 abutting the second piston face 37 opposite the first piston face 36 is compressed. As the spring member is compressed, so is the second chamber section 26, and the fluid therein flows out through a fourth channel 44*a*. The spring member, which is a helical spring surrounding part of the piston member arranged in the second chamber section 26, is thus compressed between the second piston face 37 and the piston chamber 20. The piston member has a first end 30 extending out of the piston housing 19 and engaging the projectable arm by having a circumferential groove 31 into which the first end 8 of the projectable arm extends. The second end of the projectable arm is rounded to be able to rotate in the groove. The projectable arm is pivotably connected with the first housing around a pivot point 33. In the other and second end 34 of the piston member, the piston member extends into the shaft 12. When the piston member is moved in the first direction, a space 55 is created between the second end 34 of the piston member and the shaft. This space 55 is in fluid communication with the well fluid through a third channel 35, which is illustrated by a dotted line. In this way, the piston does not have to overcome the pressure surrounding the tool in the well. The second end 34 of the piston member is provided with two circumferential seals 29 to seal off the piston chamber from the dirty well fluid.

Figure 9:
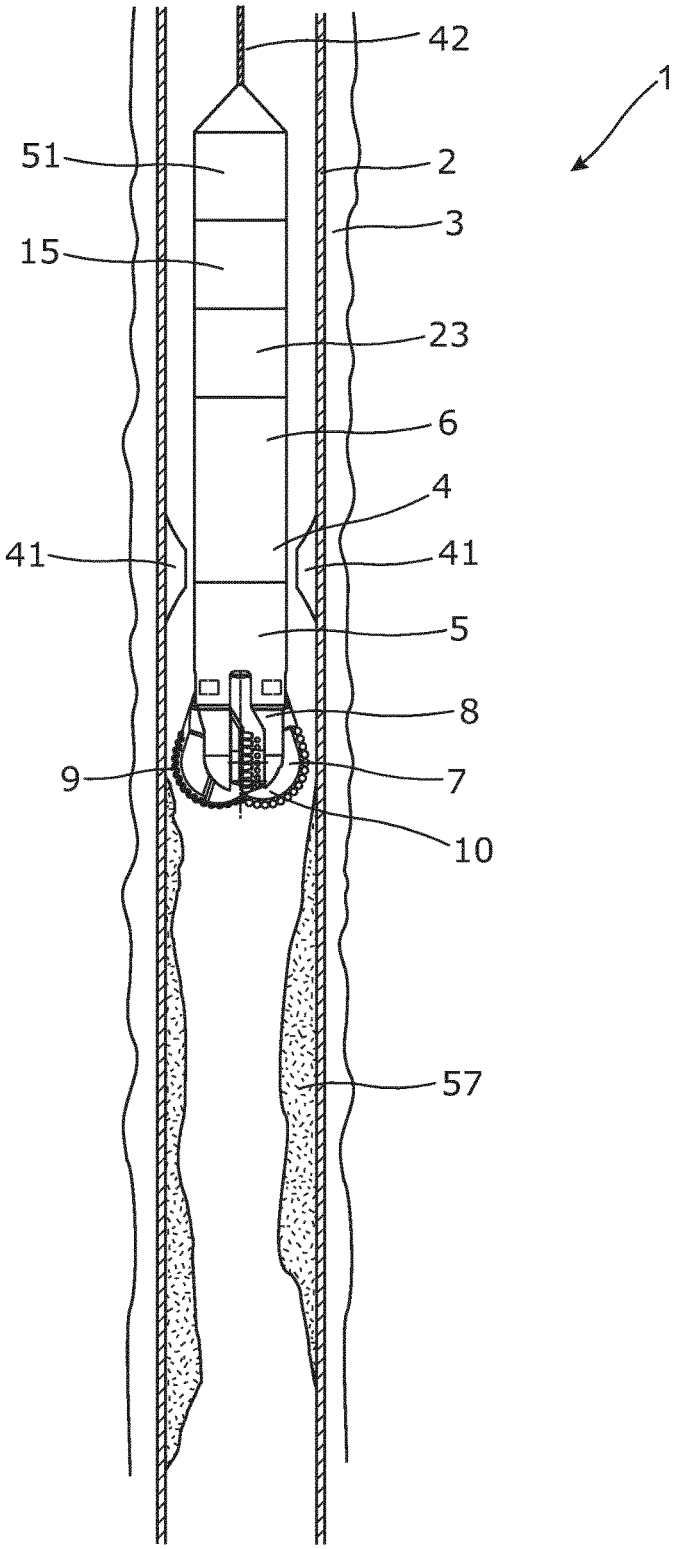
FIG. 9 shows the downhole wireline cleaning tool of FIG. 8 arranged in a well.

As shown in FIG. 9, the downhole wireline cleaning tool further comprises a pump 23 driving the arm activation assembly, the pump being driven by a motor powered through the wireline. When the cleaning operation is complete, the hydraulic pressure from the pump is no longer fed to the first channel, and the spring member 40 forces the piston member 21 in a second direction opposite the first direction along the longitudinal direction 37 of the tool, as indicated in FIG. 8.

As can be seen in FIGS. 3, 6 and 8, the arm has a curved shape curving from the second end 10 towards the first end 8. As can be seen in FIG. 2, the arm has a shape transverse to the extension, the shape being partly round as indicated by reference number 24. The bits are arranged in two rows, the two rows of bits being arranged spaced apart along the partly round shape 24. Furthermore, the rows are displaced so that one bit in one row is arranged between two bits in the other row so that bits in the second row remove what the bits in the first row did not remove.

Figure 11:
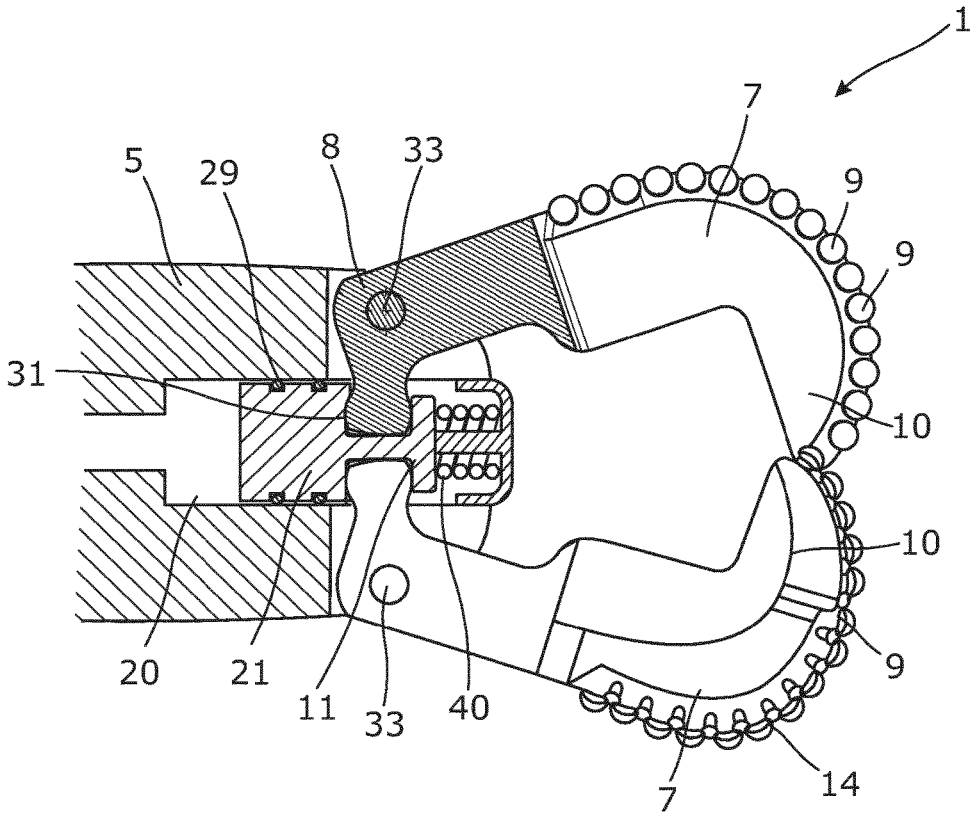
FIG. 11 shows a partly cross-sectional view of part of a downhole wireline cleaning tool.

In FIG. 11, the arm activation assembly 11 comprises a piston member 21 having a groove in which the first end of the projectable arm 7 engages, so that when the hydraulic fluid of the pump forces the piston member away from the second housing part, the arm is projected and the spring member 40 is compressed. The first housing part 5 is rotated in relation to the second housing part, and thus the bits on the arm scrape along the inner face of the casing to clean and increase the inner diameter of the casing.

Figure 12:
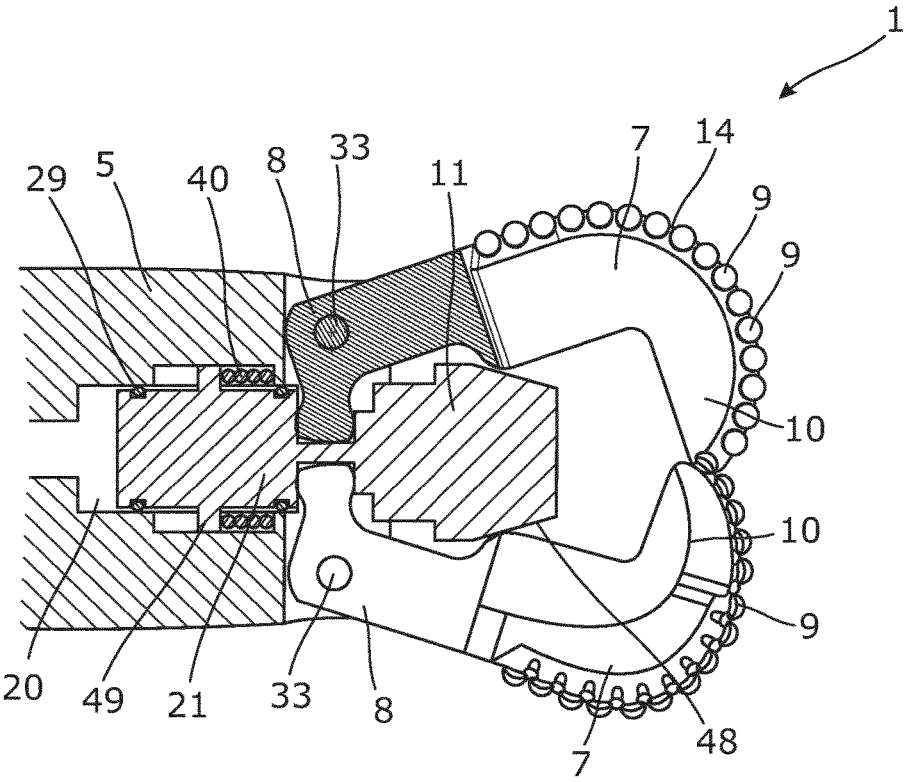
FIG. 12 shows a partly cross-sectional view of part of another downhole wireline cleaning tool.

In FIG. 12, the arm activation assembly 11 comprises a piston member 21 forcing the arms to project radially outwards by means of hydraulics. The piston member has an inclined face 48 and thus forms a cone shape which, when the piston member moves, forces the arms outwards towards the inner face of the casing as the second ends of the arms climb the inclined face of the piston member. The first ends of the arms rotate in the same way as in FIG. 11 in the groove of the piston member.

Figure 13:
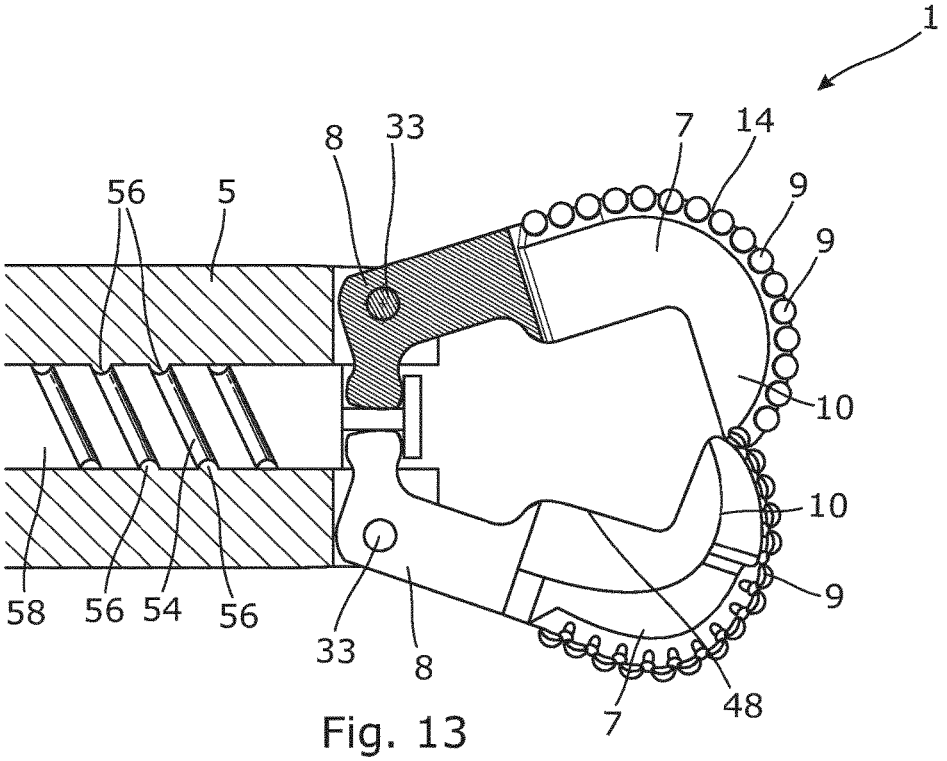
FIG. 13 shows a partly cross-sectional view of part of yet another downhole wireline cleaning tool.

The arm activation assembly of FIG. 13 comprises a worm shaft 58 in which a circumferenting groove 54 engages a projecting part in the form of a tooth 56 arranged in the first housing part 5. As the worm shaft is rotated, the arm 7 is projected due to the fact the first end of the arm engages a groove of the shaft and rotates around the pivot point 33.

As shown in FIGS. 1, 9 and 10, the downhole wireline cleaning tool 1 is thus part of a downhole system 100 having a casing 2 with a restriction 41 and some objects, such as scale, to be removed in order to clean the casing and provide better flow of hydrocarbon-containing fluid.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a driving unit 52, such as downhole tractor, can be used to push the tool all the way into position in the well, as shown in FIG. 10. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole wireline cleaning tool adapted to scrape and remove objects, and thereby increase said inner diameter to an initial inner diameter of the casing, the casing having an internal cross-sectional area encircled by a wall of the casing and the tool having a centre tool axis and extending in a longitudinal direction, comprising:

a tool housing having a first housing part and a second housing part, a projectable arm which is pivotably connected with the first housing part at a first end of the projectable arm, the projectable arm having a plurality of bits in a second end, said projectable arm being movable between a retracted position and a projected position in relation to the tool housing in order to bring the bits in contact with the object, an arm activation assembly for moving the projectable arm between the retracted position and the projected position, and a rotatable shaft arranged in the second housing part and rotatably connected with the first housing part for rotating the projectable arm, wherein the bits are arranged along an extension extending from the second end towards the first end of the projectable arm, which extension is curved in order to vary a distance from the tool housing to the bit in contact with the object upon rotation of the projectable arm, and wherein the extension of the arm extends across the centre tool axis in at least the retracted position, so that the bits of the arm are arranged to scrape the entire internal cross-sectional area of the casing when the arm is rotated.

2. A downhole wireline cleaning tool according to claim 1, wherein the downhole wireline cleaning tool has a plurality of projectable arms, and wherein the extension of at least one of the arms extends across the centre tool axis in at least the retracted position.

3. A downhole wireline cleaning tool according to claim 1, wherein the downhole wireline cleaning tool has at least two opposing projectable arms, each having the extension extending from the centre tool axis and radially outwards, so that the bits of the opposing projectable arms are arranged to scrape the entire internal cross-sectional area of the casing when the arms are rotated.

4. A downhole wireline cleaning tool according to claim 3, wherein the bits of one of the two opposing arms are arranged offset in relation to the bits of the other of the opposing arms.

5. A downhole wireline cleaning tool according to claim 1, wherein the projectable arm is pivotably connected with the first housing part around a pivot point, which pivot point is fixedly connected with the first housing part, so that during the removal of the objects, the pivot point is adapted to withstand the resulting force in the longitudinal direction.

6. A downhole wireline cleaning tool according to claim 1, wherein the bits are non-cutting bits.

7. A downhole wireline cleaning tool according to claim 1, herein the bits are scraping bits.

8. A downhole wireline cleaning tool according to claim 1, wherein the rotatable shaft rotates around the centre tool axis.

9. A downhole wireline cleaning tool according to claim 1, wherein the extension of bits is curved.

10. A downhole wireline cleaning tool according to claim 1, wherein the projectable arm activation assembly comprises:

a motor, an at least partly threaded shaft rotated by the motor, and a projectable arm activation assembly housing having a thread engaging the thread of the shaft, the threaded shaft being arranged inside the rotatable shaft.

11. A downhole wireline cleaning tool according to claim 1, wherein the projectable arm activation assembly comprises:

a piston housing arranged in the first housing part and comprising a piston chamber, and a piston member arranged inside the piston chamber to move the projectable arm between the retracted position and the projected position, the piston member being movable in the longitudinal direction of the downhole tool and having a first piston face, the piston member being capable of applying a projecting force on the projectable arm by applying hydraulic pressure on the first piston face and moving the piston in a first direction.

12. A downhole wireline cleaning tool according to claim 11, further comprising a pump driving the arm activation assembly, the pump being driven by a motor powered through the wireline.

13. A downhole wireline cleaning tool according to claim 11, wherein the piston chamber is divided into a first chamber section and a second chamber section, and the hydraulic pressure on the first piston face, moving the piston in the first direction, is applied to the first chamber section.

14. A downhole wireline cleaning tool according to claim 1, wherein the projectable arm has a curved shape curving from the second end towards the first end.

15. A downhole wireline cleaning tool according to claim 1, wherein the projectable arm has a shape transverse to the extension, the shape being partly round.

16. A downhole wireline cleaning tool according to claim 1, wherein the bits are arranged in two rows, the rows being displaced so that one bit in one row is arranged between two bits in the other row.

17. A downhole wireline cleaning tool according to claim 1, wherein a spring member is arranged in the activation assembly, applying a spring force to move the projectable arm from the projected position to the retracted position.

18. A downhole wireline cleaning tool according to claim 1, further comprising a driving unit for propelling the tool forward in the well.

19. A downhole system comprising a downhole wireline cleaning tool according to claim 1 and a casing having a restriction.

20. A cleaning method for cleaning a well having a restriction, comprising the steps of:

submerging a downhole wireline cleaning tool according to claim 1 for performing a cleaning operation, passing the restriction with the projectable arm being in the retracted position, and moving the projectable arm from the retracted position to the projected position opposite a part of the well to be cleaned.

* * * * *